US007601048B2

(12) United States Patent
Groner

(10) Patent No.: US 7,601,048 B2
(45) Date of Patent: Oct. 13, 2009

(54) APPARATUS FOR ENHANCING CLEAVAGE AND METHOD

(75) Inventor: Carolyn Groner, New Iberia, LA (US)

(73) Assignee: Cleavage Clip, L.L.C., New Iberia, LA (US)

( * ) Notice: Subject to any disclaimer, the term of this patent is extended or adjusted under 35 U.S.C. 154(b) by 0 days.

(21) Appl. No.: 11/705,320

(22) Filed: Feb. 12, 2007

(65) Prior Publication Data

US 2009/0126163 A1 May 21, 2009

(51) Int. Cl.
*A41C 3/00* (2006.01)

(52) U.S. Cl. ..... 450/86; 2/336; 224/197; 224/198; 224/300

(58) Field of Classification Search ..... 450/86, 450/88, 1, 18, 25, 63, 64, 93; 24/197, 198, 24/200, 199, 310, 312, 313; 2/67, 336, 338, 2/312–318, 320, 321, 335, 326, 268, 271, 2/323, 319, 324–330

See application file for complete search history.

(56) References Cited

U.S. PATENT DOCUMENTS 4,276,884 A 7/1981 O'Daniels
4,612,935 A 9/1986 Greifer
4,858,249 A 8/1989 Stewart
5,149,293 A 9/1992 Gable
5,935,044 A 8/1999 Brewster
5,964,642 A * 10/1999 Fildan ..... 450/86
6,006,364 A 12/1999 Newson et al.
6,056,625 A * 5/2000 Fildan ..... 450/86
6,135,853 A 10/2000 Hopson
6,163,937 A 12/2000 McKinnis et al.
6,381,752 B1 5/2002 Cartelli
6,406,354 B1 6/2002 Yamauchi et al.

* cited by examiner

*Primary Examiner*—Gloria Hale
(74) *Attorney, Agent, or Firm*—Jones Walker

(57) ABSTRACT

A device and method used with a woman's garment, including a brassiere. The device comprises a ring member having a first segment and a second segment, a front side and a back side, and wherein the ring member has a mid-way point between the first and second segment. The device further comprises a first prong extending from the first end of the ring member, with the first prong having a length terminating at a distance less than the mid-way point of the ring member, and a second prong extending from the second end of the ring member, with the second prong having a length terminating at a distance less than the mid-way point of the ring member. In the most preferred embodiment, the center portion allows for passage of the right shoulder strap and the left shoulder.

11 Claims, 5 Drawing Sheets

APPARATUS FOR ENHANCING CLEAVAGE AND METHOD

BACKGROUND OF THE INVENTION

This invention relates to an apparatus for enhancing cleavage and method. More specifically, but without limitation, this invention relates to an apparatus and method to enhance cleavage of a person wearing a brassiere.

A brassiere is an undergarment worn by women to support and give contour to the body. Over the years, many devices have been developed that aid in the women's comfort as well as complimenting the women's figure while wearing the brassiere. Some devices in the prior art have structural functions such as securing shoulder straps. For instance, in U.S. Pat. No. 5,935,044, the patent discloses an apparatus used to secure shoulder straps in a selected position that prevents the straps from sliding off the shoulders of the user. Other devices are designed to spread pressure applied by the shoulder straps, such as seen in U.S. Pat. No. 4,612,935.

As understood by those of ordinary skill in the art, another desirable property of a brassiere is to enhance the shape of the user. For instance, many brassiere designs also seek to enhance cleavage of the user. These specialty brassieres are expensive and not always effective. Also, these types of brassieres can be bulky and uncomfortable to wear.

Therefore, there is a need for a brassiere that will enhance the natural shape of the user. There is also a need for an apparatus and method that is used with a brassiere that will enhance the cleavage of the user and is comfortable to wear. Further, there is a need for a device and method for enhancing the cleavage of the user that is economical to manufacture. Additionally, there is a need for a device and method that is intuitive to use so that the device can be applied to commercially available brassieres quickly and easily. These needs, as well as many others, will become apparent from the present description of the embodiments that follow.

SUMMARY OF THE INVENTION

A device used with a brassiere is disclosed. The brassiere contains a right cup and a left cup, a right shoulder strap leading from the right cup and a left shoulder strap leading from the left cup. The brassiere also includes a back band connected to the right shoulder strap and the left shoulder strap. The device comprises a ring member having a first segment and a second segment, a front side and a back side, and wherein the ring member has a mid-way point between the first and second segment.

The device further comprises a first prong extending from the first segment of the ring member, with the first prong having a length terminating at a distance less than the mid-way point of the ring member, and a second prong extending from the second segment of the ring member, with the second prong having a length terminating at a distance less than the mid-way point of the ring member. In the most preferred embodiment, the center portion allows for passage of the right shoulder strap and the left shoulder strap.

In one preferred embodiment, the first prong has an aft end that is raised relative to the front side and the second prong has an aft end that is raised relative to the front side. The ring member, in one preferred embodiment, contains a center portion that is unobstructed by the first prong and the second prong. Also, the ring member has a wall thickness and a face thickness, and wherein the face thickness is greater the wall thickness. In one preferred embodiment, the device is made of plastic.

The first prong, in one preferred embodiment, has an base portion attached to the ring member and an apex portion extending therefrom, and wherein the base portion of the first prong has a greater thickness than the apex portion of the first prong. Additionally, the second prong has a base portion attached to the ring member and an apex portion extending therefrom, and wherein the base portion of the second prong has a greater thickness than the apex portion of the second prong.

A method of providing enhanced cleavage to a person wearing a brassiere is also provided. The brassiere includes a right cup and a left cup, a right shoulder strap leading from the right cup and a left shoulder strap leading from the left cup, and a back band connected to the right shoulder strap and the left shoulder strap. The method comprises providing an apparatus. The apparatus comprises: a ring member having a first and second segment, and a front and back side; a first prong extending from the first segment, with the first prong having a length terminating at a distance less than a mid-way point of the ring member; a second prong extending from the second segment, with the second prong having a length terminating at a distance less than the mid-way point of the ring member; and wherein the first and second prong are configured to form an unobstructed center portion of the ring member.

The method further comprises placing the right strap through the center portion, placing the left strap through the center portion, lifting the right cup upward and to the left, and lifting the left cup upward and to the right so that the cleavage of the person is enhanced. In one preferred embodiment, the ring member is an oval ring member and wherein the first segment is on one end of the oval ring member, and the second segment is on an opposite end of the oval ring member.

A women's garment comprising a right cup and a left cup, a right shoulder strap leading from the right cup and a left shoulder strap leading from the left cup, and a back band connected to the right shoulder strap and said left shoulder strap is also disclosed. The garment in this embodiment further comprises an elliptical ring member having a first end and a second end, with the ring member having a front side and a back side, with the ring member having a mid-way point between the first end and the second end. The garment further includes a first prong extending from the first end of the ring member, with the first prong having a length terminating at a distance less than the mid-way point of the ring member, a second prong extending from the second end of the ring member, with the second prong having a length terminating at a distance less than the mid-way point of the ring member, and wherein the first prong and the second prong are configure to form a center portion of the ring member that is unobstructed.

An advantage of the present invention is the discreet nature of its use i.e. third parties can not detect use of the device. Another advantage of the present disclosure is that the apparatus is takes up very little space. Yet another advantage is that the device is comfortable to wear. Yet another advantage is that the device is economical to manufacture. Still yet another advantage is that the use of the device is intuitive to the user.

Yet another advantage is that the disclosed device creates a razorback brassiere without having to purchase a costly specialty garment. Another advantage is that small breasted women with no cleavage will realize cleavage, medium breasted women with cleavage will realize greater cleavage, and large breasted women will realize greater support and lift.

A feature of the present disclosure is the first and second prongs, wherein the first and second prongs are on opposite sides of the ring member. Yet another advantage is that the first and second prongs are attached to the front face, while the back side is smooth for a comfortable fit by the user. Yet another feature is the first and second prongs extend towards the center portion of the ring member at a raised angle. Another feature is that in the most preferred embodiment, the ring member is an oval shape. Still yet another feature is the unobstructed center area for passage of the straps.

Another feature is the device may be used with women's swim wear. As used herein, women's swim wear includes bikini tops and one piece swimsuits. In other words, it is within the teachings of the present invention to use the device with a women's swimsuit. Yet another feature is that the device also eliminates falling brassiere straps.

DETAILED DESCRIPTION OF THE PREFERRED EMBODIMENTS

Figure 1:
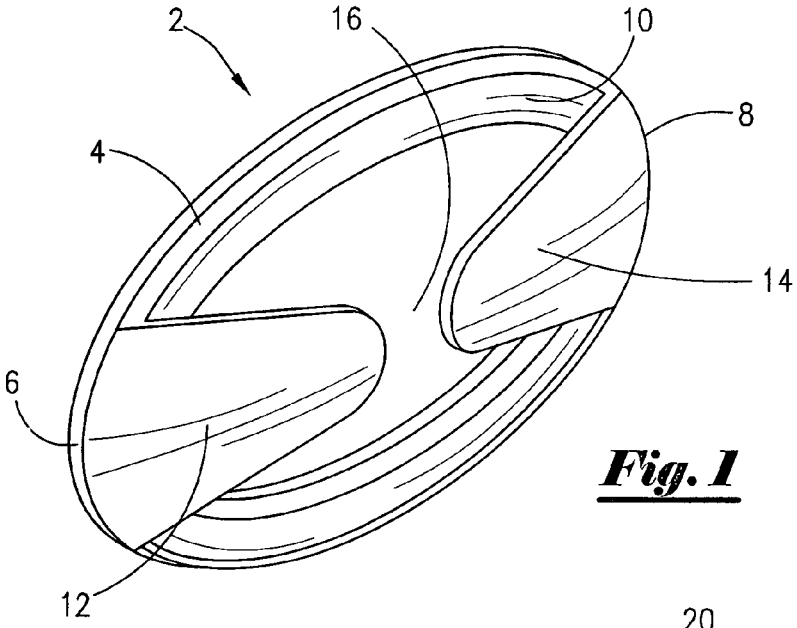
FIG. 1 is a perspective view of the device of the present invention.

Referring now to FIG. 1, a perspective view of the device 2 of the present invention will now be described. The device 2 includes a ring member, seen generally at 4, which in the most preferred embodiment is an oval member 4. The ring member 4 has a first end 6 (sometimes referred to as first segment 6) and a second end 8 (sometimes referred to as second segment 8). The ring member 4 contains a front side 10 as well as a back side (not seen in this view).

As shown in FIG. 1, a first prong 12 extends from the first end 6 and wherein the first prong 12 is attached to the front side 10. A second prong 14 extends from the second end 8 and wherein the second prong 14 is attached to the front side 10. The first prong 12 has a length that terminates at a distance less than the mid-way point 16 between the ends 6, 8 of the ring member 4. Additionally, the second prong 14 has a length that terminates at a distance less than the mid-way point 16 of the ring member 4.

Figure 2:
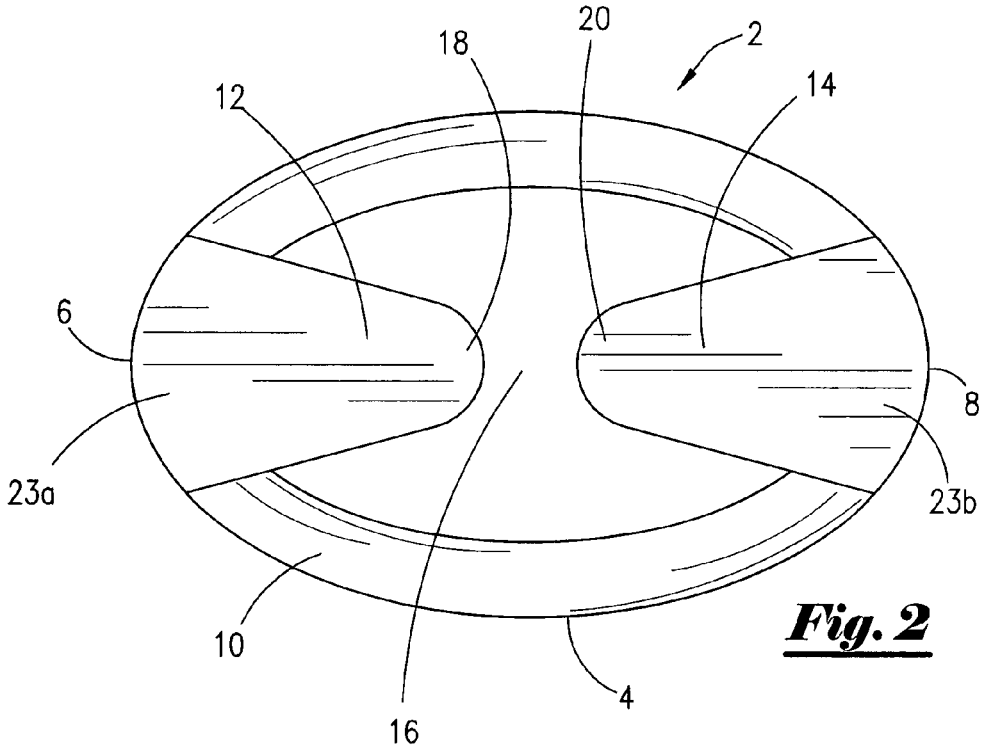
FIG. 2 is a front view of the device seen in FIG. 1.

Referring now to FIG. 2, a front view of the device 2 seen in FIG. 1 will now be described. It should be noted that like numbers appearing in the various figures refer to like components. This view depicts the prongs 12, 14 extending from the front side 10 of the ring member 4. The mid-way point 16 is also shown. As seen in FIG. 2, the prongs 12, 14 have a pointy end.

Figure 3:
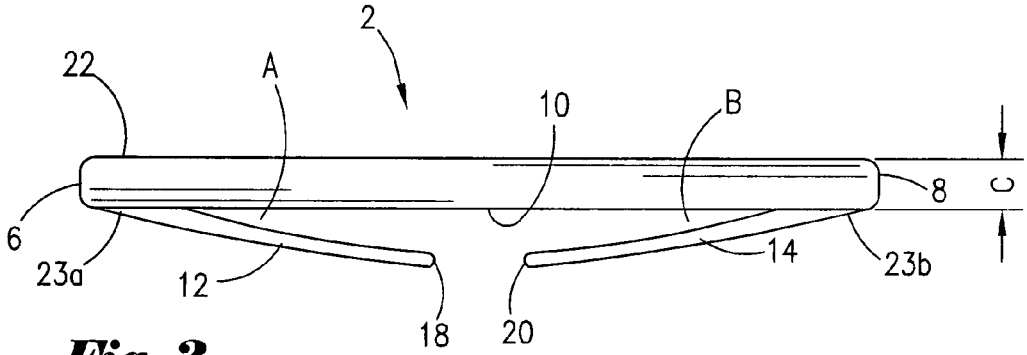
FIG. 3 is a top view of the device seen in FIG. 2.

FIG. 3 illustrates the top view of the device 2 seen in FIG. 2. More specifically, FIG. 3 depicts the first prong 12 extending from the end 6 and the second prong 14 extending from the end 8. The aft end 18 (also referred to as apex portion) of the prong 12 is raised relative to the front side 10, and wherein the angle in the most preferred embodiment is between 5 and 30 degrees, denoted by the letter A. The aft end 20 (also referred to as apex portion) of the prong 14 is raised relative to the front side 10, and wherein the angle in the most preferred embodiment is between 5 and 30 degrees, denoted by the letter B. FIG. 3 also depicts the back side 22, and wherein the back side 22 will engage with the user's back as will be more fully explained later in the application. The wall thickness of the ring member 4 is denoted by the letter C.

Referring collectively to FIGS. 2 and 3, the first prong 12 has a base portion 23*a* attached to the end 6 and an apex portion 18 extending therefrom, and wherein the base portion 23*a* of the first prong 12 has a greater thickness than the apex portion 18 of the first prong 12. The second prong 14 has a base portion 23*b* attached to the end 8 and an apex portion 20 extending therefrom, and wherein the base portion 23*b* of the second prong 14 has a greater thickness than the apex portion 20 of the second prong 14.

Figure 4:
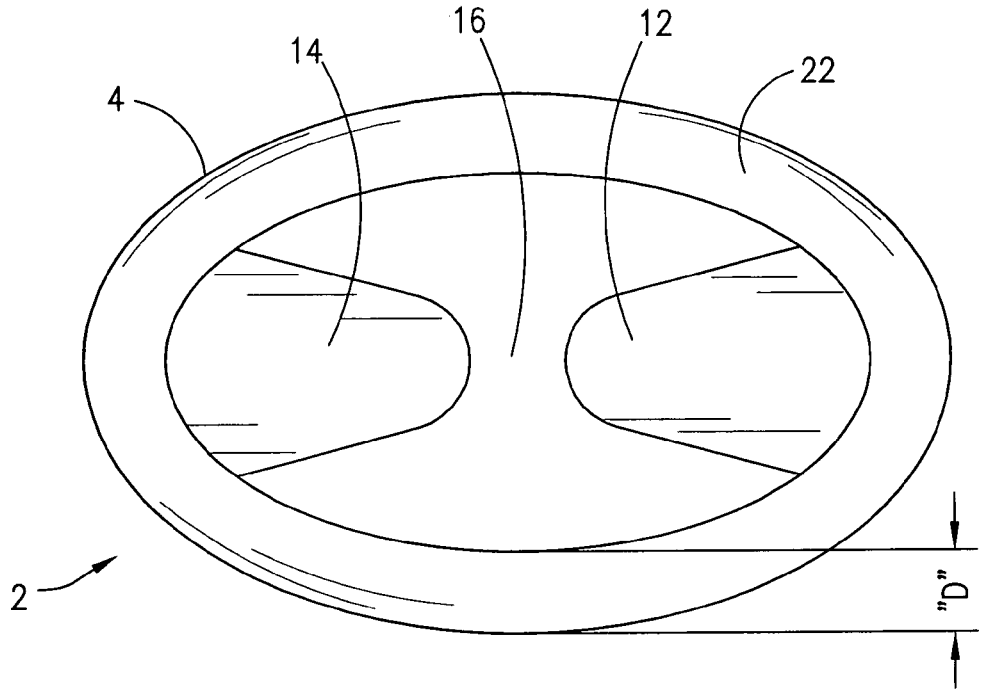
FIG. 4 is a back view of the device seen in FIG. 3.

Referring now to FIG. 4, a back view of the device seen in FIG. 3 will now be described. The back side 22 is shown along with the first prong 12, the second prong 14, and the mid-way point 16. Hence, there is configured an unobstructed center area about the mid-way point 16 for passage of the shoulder straps. FIG. 4 further depicts the thickness D of the face. It will be appreciated that the face thickness D is greater than the wall thickness C.

Figure 5:
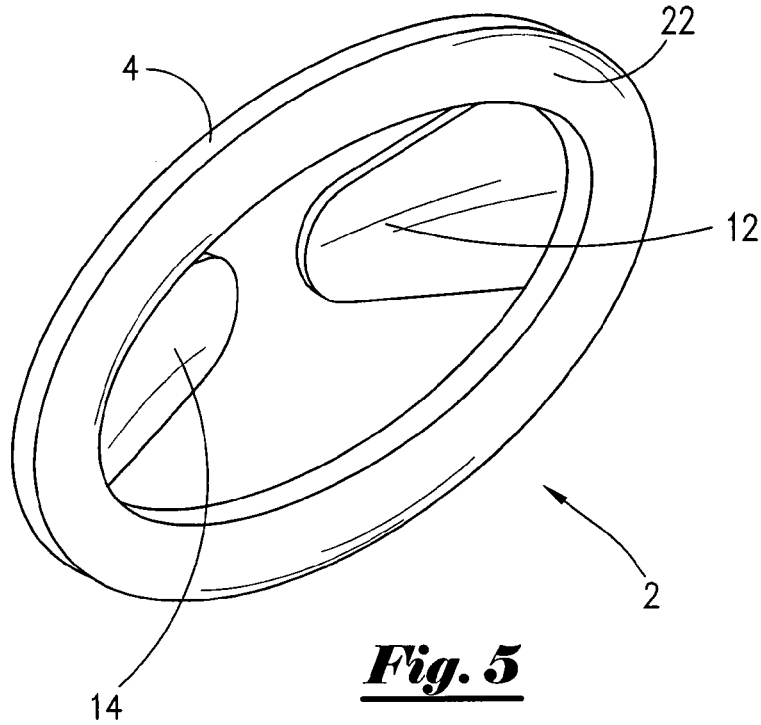
FIG. 5 is a perspective view of the device seen in FIG. 1 from the opposite side.

FIG. 5 is a perspective view of the device 2 seen in FIG. 1 from the opposite side. Hence, the back side 22 is seen, and wherein the back side 22 is configured to engage the back of the user. The prongs 12, 14 are seen, and wherein the prongs 12, 14 do not interfere with the back side 22.

Figure 6:
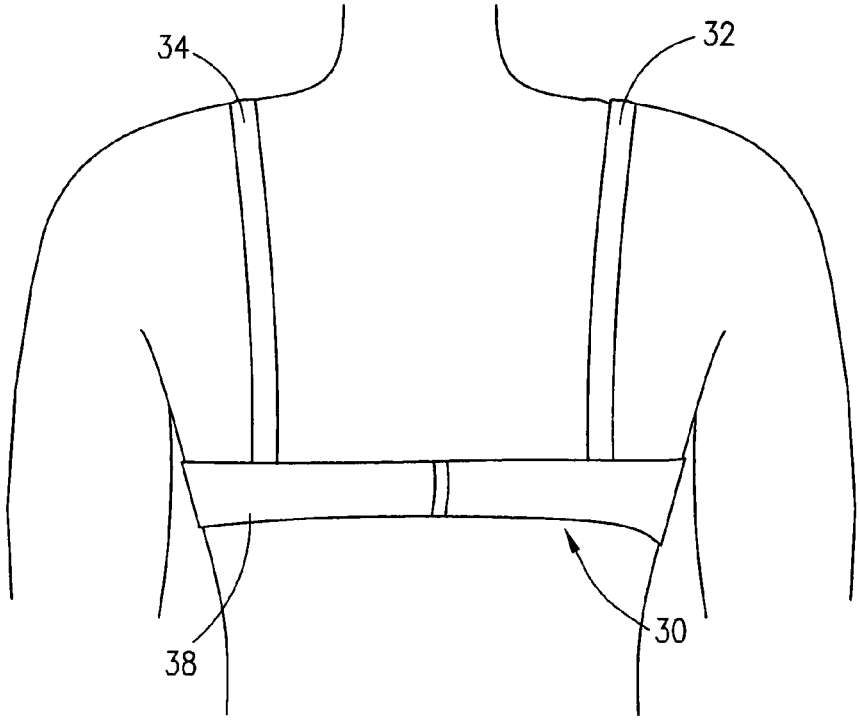
Fig. 6 PRIOR ART
FIG. 6 is an illustration of a prior art brassiere.
Figure 7:
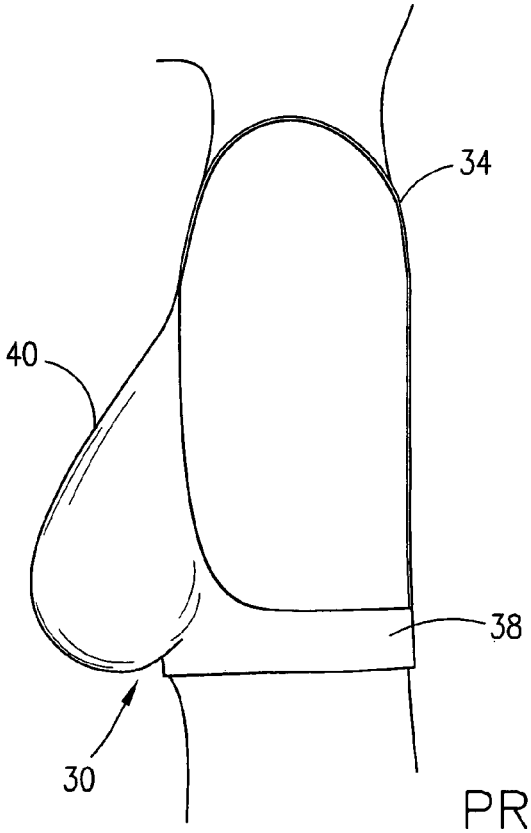
Fig. 7 PRIOR ART
FIG. 7 is a side view of the prior art brassiere seen in FIG. 6.
Figure 8:
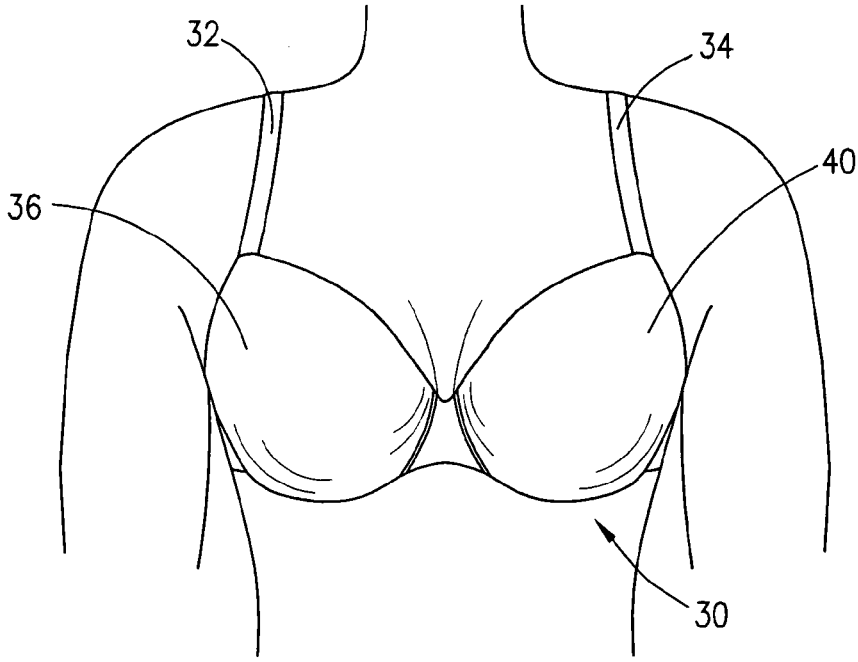
Fig. 8 PRIOR ART
FIG. 8 is a front view of the prior art brassiere seen in FIG. 6.
Figure 10:
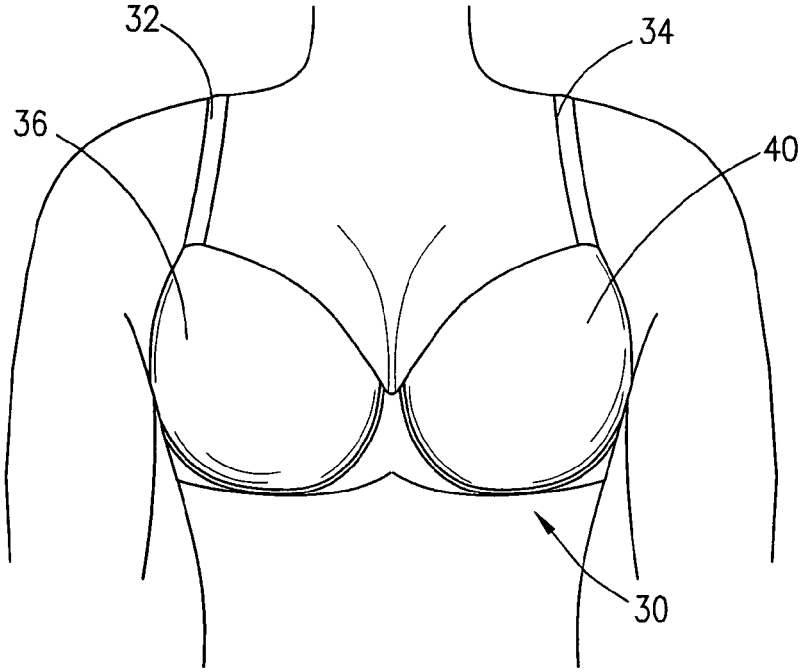
FIG. 10 is a front view of the present device seen in FIG. 9 applied to the prior art brassiere.

FIG. 6 depicts a prior art brassiere 30. The brassiere 30 contains the right strap 32 and the left strap 34. FIG. 7 depicts a side view of the prior art brassiere 38. The right strap 32 is connected to the right cup 36 and the band 38, while the left cup 40 is connected to the left strap 34, which in turn the strap 34 is connected to the band 38. FIG. 8 depicts the front view of the prior art brassiere 30.

Figure 9:
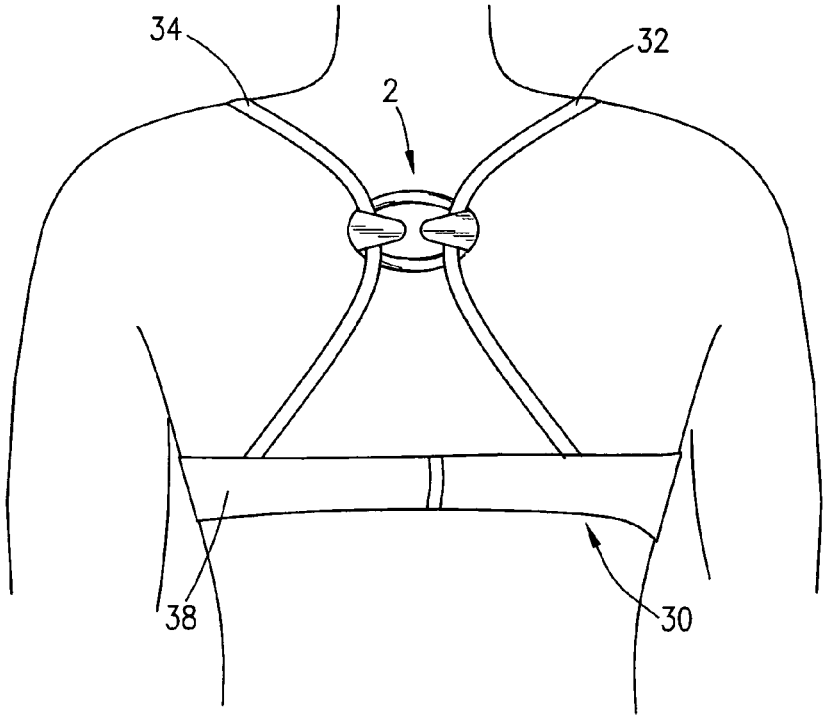
FIG. 9 is a back view of the present device applied to a prior art brassiere.
Figure 11:
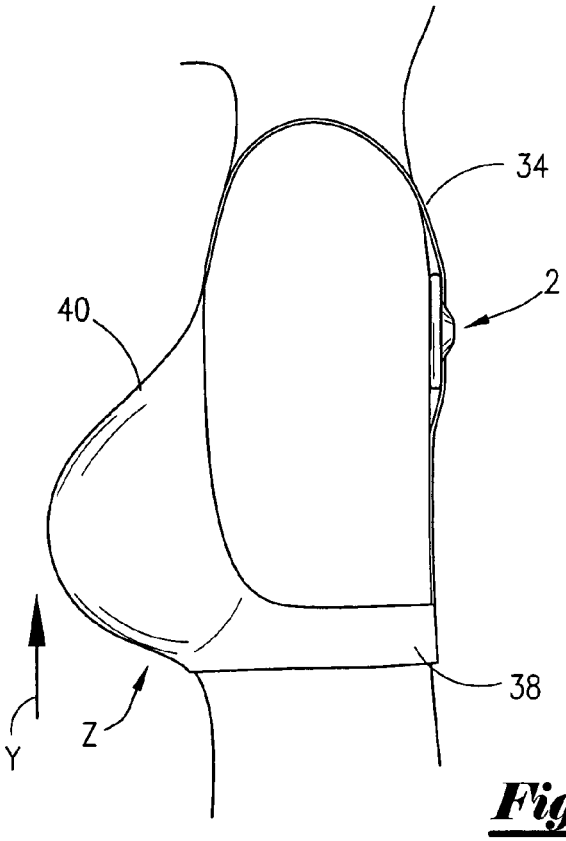
FIG. 11 is a side view of the present device seen in FIG. 9 applied to the prior art brassiere.

Referring now to FIG. 9, the device 2 as applied to the pair of brassiere straps 32, 34 is illustrated. Hence, in accordance with the teachings of the present invention, the right strap and left strap is placed through the open center area of device 2. The right cup is lifted upward and to the left and the left cup is lifted upward and to the right (as seen in the front illustrated view) so that the cleavage of the user is enhanced. FIG. 11 is a side view illustration of the brassiere 30 with the device 2 showing the uplifted cup as well as the back side 22 up against the back of the user. Arrow Y depicts the applied uplifting force to the cup. As seen by the arrow z, the cup has actually been raised.

Although the present invention has been described in terms of specific embodiments, it is anticipated that alterations and modifications thereof will no doubt become apparent to those of ordinary skill in the art. It is therefore intended that the following claims be interpreted a covering all such alterations and modifications as fall within the true spirit and scope of the invention.

I claim:

1. A device used with a brassiere, said brassiere containing a right cup and a left cup, a right shoulder strap leading from the right cup and a left shoulder strap leading from the left cup, and a back band connected to said right shoulder strap and said left shoulder strap, and wherein the device comprises:

a ring member having a first segment and a second segment, said ring member having a front side and a back side, said ring member having a mid-way point between said first segment and said second segment;

a first prong extending from said first segment of said ring member, said first prong having a length terminating at a distance less than the mid-way point of said ring member, wherein said first prong has an aft end that is raised relative to said front side, wherein said first prong has a base portion attached to said ring member and an apex portion extending therefrom, and wherein the base portion of said first prong has a greater thickness than the apex portion of the first prong;

a second prong extending from said second segment of said ring member, said second prong having a length terminating at a distance less than the mid-way point of said ring member, wherein said second prong has an aft end that is raised relative to said front side, wherein said second prong has a base portion attached to said ring member and an apex portion extending therefrom, and wherein the base portion of said second prong has a greater thickness than the apex portion of the second prong; and wherein said device is a unitary piece.

2. The device of claim 1 wherein said ring member contains a center portion that is unobstructed by said first prong and said second prong.

3. The device of claim 2 wherein said ring member has a wall thickness and a face thickness, and wherein said face thickness is greater the wall thickness.

4. The device of claim 3 wherein said center portion forms a passage for the right shoulder strap and the left shoulder strap.

5. A device used with a women's garment, said women's garment containing a right cup and a left cup, a right shoulder strap leading from the right cup and a left shoulder strap leading from the left cup, and a back band connected to said right shoulder strap and said left shoulder strap, and wherein the device comprises:

an elliptical ring member having a first end and a second end, said ring member having a front side and a back side, said ring member having a mid-way point between said first end and said second end;

a first prong extending from said first end of said ring member, said first prong having a length terminating at a distance less than the mid-way point of said ring member, wherein said first prong has an aft end that is raised relative to said front side, wherein said first prong has a base portion attached to said ring member, and wherein said aft end extends from said base portion, and wherein the base portion of said first prong has a greater thickness than the aft end of the first prong;

a second prong extending from said second end of said ring member, said second prong having a length terminating at a distance less than the mid-way point of said ring member, wherein said second prong has an aft end that is raised relative to said front side, wherein said second prong has a base portion attached to said ring member, and wherein said aft end extends from said base portion, and wherein the base portion of said second prong has a greater thickness than the aft end of the second prong;

wherein said first prong and said second prong are configured to form a center portion of said ring member that is unobstructed; and wherein said device is a unitary piece.

6. The device of claim 5 wherein said unobstructed center portion is configured to allow for passage of the right shoulder strap and the left shoulder strap.

7. The device of claim 6 wherein said ring member has a wall thickness and a face thickness, and wherein said face thickness is greater the wall thickness.

8. The device of claim 5 wherein said device is constructed of a plastic.

9. A method of providing enhanced cleavage to a person wearing a brassiere, the brassiere containing a right cup and a left cup, a right shoulder strap leading from the right cup and a left shoulder strap leading from the left cup. and a back band connected to said right shoulder strap and said left shoulder strap, the method comprising:

providing an apparatus, the apparatus comprising: a ring member having a first segment and a second segment, said ring member having a front side and a back side; a first prong extending from said first segment, said first prong having a length terminating at a distance less than a mid-way point of said ring member, a second prong extending from said second segment, said second prong having a length terminating at a distance less than the mid-way point of said ring member; and wherein said first prong and said second prong are configured to form an unobstructed center portion of said ring member; wherein said first prong has an aft end that is raised relative to said front side; wherein said second prong has an aft end that is raised relative to said front side; wherein said device is a unitary piece; wherein said first prong has a base portion attached to said ring member, and wherein said aft end of said first prong extends from said base portion, and wherein the base portion of said first prong has a greater thickness than the aft end of the first prong; and wherein said second prong has a base portion attached to said ring member, and wherein said aft end of said second prong extends from said base portion, and wherein the base portion of said second prong has a greater thickness than the aft end of the second prong;

placing the right strap through the center portion;

placing the left strap through the center portion;

lifting the right cup upward and to the left;

lifting the left cup upward and to the right so that the cleavage of the person is enhanced.

10. The method of claim 9 wherein the ring member is an oval ring member and wherein said first segment is on one end of said oval ring member, and said second segment is on an opposite end of said oval ring member.

11. A woman's garment comprising:

a right cup and a left cup;

a right shoulder strap leading from the right cup and a left shoulder strap leading from the left cup;

a back band connected to said right shoulder strap and said left shoulder strap;

an elliptical ring member having a first end and a second end, said ring member having a front side and a back side, said ring member having a mid-way point between said first end and said second end;

a first prong extending from said first end of said ring member, said first prong having a length terminating at a distance less than the mid-way point of said ring member, wherein said first prong has an aft end that is raised relative to said front side, wherein said first prong has a base portion attached to said ring member, and wherein said aft end extends from said base portion, and wherein the base portion of said first prong has a greater thickness than the aft end of the first prong;

a second prong extending from said second end of said ring member, said second prong having a length terminating at a distance less than the mid-way point of said ring member, wherein said second prong has an aft end that is raised relative to said front side, wherein said second prong has a base portion attached to said ring member, and wherein said aft end extends from said base portion, and wherein the base portion of said second prong has a greater thickness than the aft end of the second prong;

wherein said first prong and said second prong are configured to form a center portion of said ring member that is unobstructed; and wherein said device is a unitary piece.

* * * * *